US008979231B2

(12) United States Patent
Nieda et al.

(10) Patent No.: US 8,979,231 B2
(45) Date of Patent: Mar. 17, 2015

(54) RECORDING APPARATUS

(75) Inventors: Kengo Nieda, Kawasaki (JP); Kazuya Koizumi, Saitama (JP); Satoshi Azuma, Kawasaki (JP); Koichiro Kawaguchi, Yokohama (JP); Toshiki Takeuchi, Tokyo (JP); Shigeru Toriihara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 13/368,086

(22) Filed: Feb. 7, 2012

(65) Prior Publication Data

US 2012/0206520 A1 Aug. 16, 2012

(30) Foreign Application Priority Data

Feb. 10, 2011 (JP) ..... 2011-027541

(51) Int. Cl.
*B41J 29/38* (2006.01)

(52) U.S. Cl.
CPC ..... *B41J 29/38* (2013.01)
USPC ..... 347/11; 347/5; 347/10; 347/14

(58) Field of Classification Search
CPC ..... B41J 29/38
See application file for complete search history.

(56) References Cited

U.S. PATENT DOCUMENTS

| | | | | |
|---|---|---|---|---|
| 2007/0165073 | A1 * | 7/2007 | Nunokawa | 347/57 |
| 2008/0100655 | A1 * | 5/2008 | Furuya et al. | 347/14 |
| 2009/0003854 | A1 * | 1/2009 | Naoi et al. | 399/38 |
| 2009/0290184 | A1 * | 11/2009 | Nishida et al. | 358/1.13 |

FOREIGN PATENT DOCUMENTS

| | | | | |
|---|---|---|---|---|
| JP | 2007-301768 A | | 11/2007 | |
| JP | 2007301768 | * | 11/2007 | B41J 2/01 |

* cited by examiner

*Primary Examiner* — Manish S Shah
*Assistant Examiner* — Jeremy DeLozier
(74) *Attorney, Agent, or Firm* — Canon USA, Inc. IP Division

(57) ABSTRACT

A recording apparatus includes a recording head, a roller configured to convey a recording medium, an acquisition unit configured to acquire information about a conveyance amount for conveying the recording medium per a predetermined rotation amount of the roller, a recording timing generation unit configured to generate a plurality of timing signals for performing recording for one raster line according to a rotation of the roller during one rotation thereof, and a drive signal generation unit configured to generate a drive reference signal for performing the recording for the one raster line on the recording medium at a predetermined interval based on the conveyance amount information and the timing signal.

21 Claims, 9 Drawing Sheets

FIG. 4B

| EDGE | RASTER COUNT | DELAY TIME | Tp | Tr |
|---|---|---|---|---|
| Eg0 | 2 | Dt0 | $T_{P0}$ | Tr0 |
| Eg1 | 1 | Dt1 | $T_{P1}$ | – |
| Eg2 | 2 | Dt2 | $T_{P2}$ | Tr2 |
| Eg3 | 1 | Dt3 | $T_{P3}$ | – |

RECORDING APPARATUS

BACKGROUND OF THE INVENTION

1. Field of the Invention

The present invention relates to a recording apparatus.

2. Description of the Related Art

Japanese Patent Application Laid-Open No. 2007-301768 discusses that, to perform recording on a recording medium that is being conveyed, drive timing of a recording head is adjusted corresponding to an angular velocity of a driving roll. Further, it discusses that eccentricity data is previously stored in a memory, a reference clock signal is set delayed based on a delay time corresponding to an amount of the eccentricity of a roll and a delay time corresponding to the angular velocity, and then a print clock is output. Furthermore, it discusses that a print timing signal is output based on the print clock.

Even without considering influence of the eccentricity of the roll, a rotational velocity of the driving roll included in a conveyance unit may not correspond to a conveyance speed of a recording medium. The driving roll is rotated by driving a motor, which is a drive source of the driving roll, at a predetermined speed. In this conveyance configuration, an error can be caused between the assumed conveyance speed of the recording medium and the actual conveyance speed thereof. The error depends on conditions (type and size of the recording medium, environment temperature, and environment moisture) when a recording apparatus performs a recording operation. For example, a cause of the error can be a diameter of the roller that varies depending on the environment temperature, pressing force of a pinch roller that varies depending on a size of the recording medium to be conveyed, and a friction force between the recording medium and the roller depending on a type of the recording medium.

Thus, it is demanded that the number of lines to be recorded on the recording medium is adjusted corresponding to a rotation amount of the driving roll to perform the recording. According to Japanese Patent Application Laid-Open No. 2007-301768, correction of the eccentricity of the roll can be controlled but adjustment of the number of lines to be recorded on the recording medium cannot be controlled.

SUMMARY OF THE INVENTION

According to an aspect of the present invention, a recording apparatus includes a recording head, a roller configured to convey a recording medium, an acquisition unit configured to acquire information about a conveyance amount for conveying the recording medium per a predetermined rotation amount of the roller, a recording timing generation unit configured to generate a plurality of timing signals for performing recording for one raster line according to a rotation of the roller during one rotation thereof, and a drive signal generation unit configured to generate a drive reference signal for performing the recording for the one raster line on the recording medium at a predetermined interval based on the conveyance amount information and the timing signal.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4B illustrates parameters of the drive reference signal.

DESCRIPTION OF THE EMBODIMENTS

Various exemplary embodiments, features, and aspects of the invention will be described in detail below with reference to the drawings.

Figure 1:
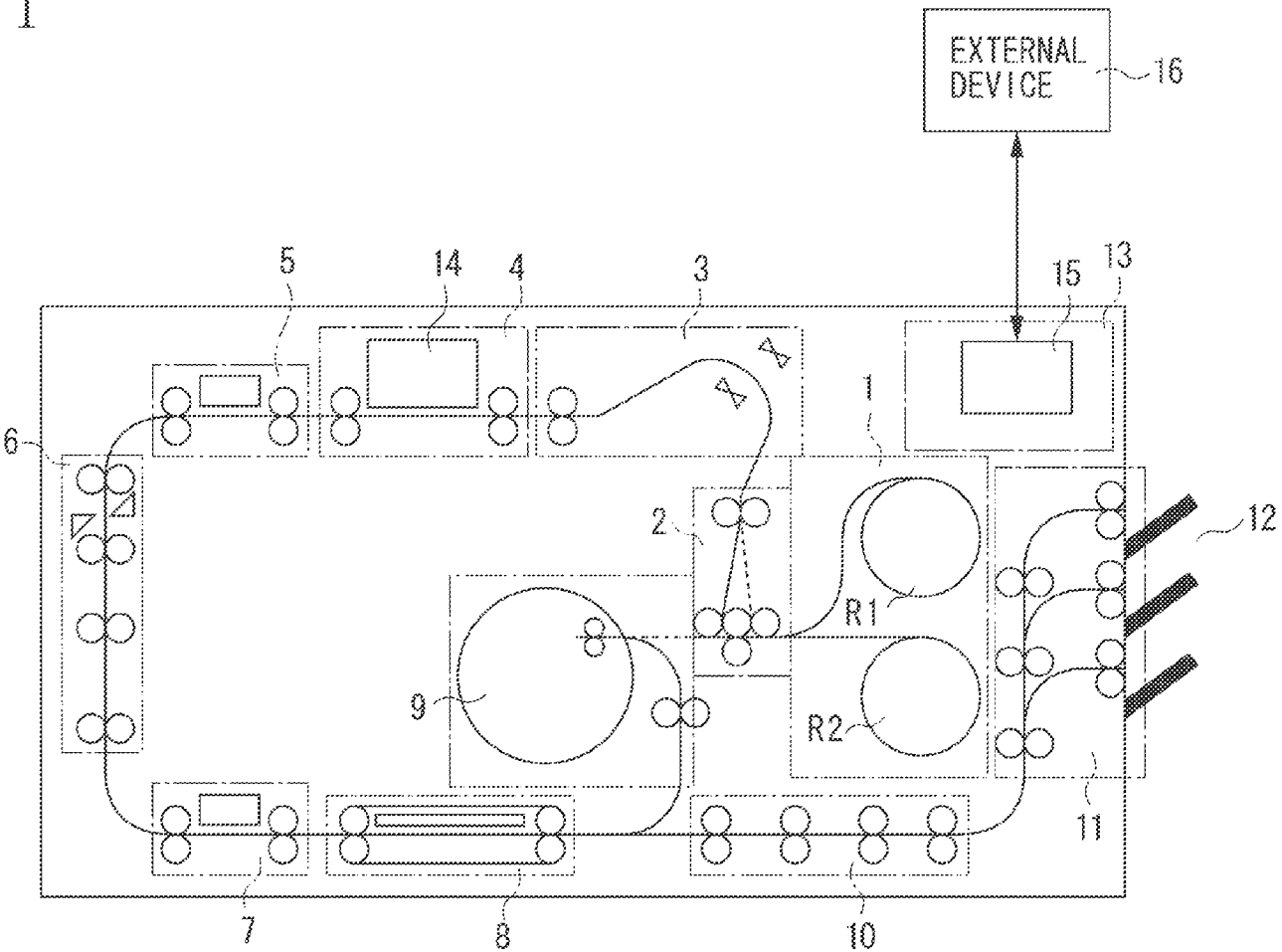
FIG. 1 illustrates an internal configuration of a recording apparatus of the present invention.

A printer (recording apparatus) performs recording on a continuous sheet wound in a roll shape. FIG. 1 is a schematic diagram of a cross sectional view illustrating an internal configuration of the printer. The printer includes a sheet supply unit 1, a de-curl unit 2, a skew correction unit 3, a print unit 4, a test unit 5, a cutter unit 6, an information recording unit 7, a drying unit 8, a sheet winding unit 9, a discharge and conveyance unit 10, a sorter unit 11, a discharge tray 12, and a control unit 13. The sheet is conveyed by a conveyance mechanism including a pair of rollers and belts along a sheet conveyance pathway indicated with solid lines in FIG. 1 and processing is performed by each unit.

The sheet supply unit 1 stores and supplies the continuous sheet wound in a roll shape. The sheet supply unit 1 can store two rolls R1 and R2, and alternatively draws and supplies the sheet. The number rolls that can be stored is not limited to two, and any number of rolls greater than or equal to one roll can be stored.

The de-curl unit 2 reduces curl (warpage) of the sheet supplied from the sheet supply unit 1. By using two pinch rollers for one driving roller, the de-curl unit 2 strokes the sheet to give the warpage in an opposite direction of the curl to reduce the curl.

The skew correction unit 3 corrects skew (inclination against an original traveling direction) of the sheet that has passed the de-curl unit 2. The skew of the sheet is corrected by pressing an edge of the sheet at a reference side to a guide member.

The print unit 4 forms an image on the sheet that is being conveyed by using the recording head 14. The print unit 4 also includes a plurality of conveyance rollers (conveyance members) that convey the sheet.

The recording head 14 includes the recording head of a line type on which a nozzle array of an inkjet method is formed within a range for covering the maximum width of the sheet that is assumed to be used. The recording head 14 includes a plurality of the recording heads disposed in parallel in a conveyance direction. According to the present exemplary embodiment, seven recording heads corresponding to seven colors of cyan (C) ( ) magenta (M), yellow (Y), light cyan (LC), light magenta (LM), gray (G), and black (K) are included. Furthermore, the number of colors and the number of recording heads are not limited to seven.

An inkjet method can adopt a method using an electrothermal conversion device, a method using a piezoelectric element, a method using an electrostatic element, and a method using a micro electromechanical system (MEMS) element, as a recording element. Each color ink is supplied to the recording head 14 from an ink tank through an ink tube.

The test unit 5 optically reads a test pattern and the image printed on the sheet by the print unit 4, to test a state of the nozzles of the recording heads, a state of conveying the sheet, and an image position.

The cutter unit 6 includes a mechanical cutter for cutting a printed sheet by a predetermined length. The cutter unit 6 includes a plurality of conveyance rollers for sending the sheet to a next processing. The information recording unit 7 records print information including a serial number and date of printing on a rear surface of the cut sheet. The drying unit 8 heats up the sheet printed by the print unit 4 and dries applied ink in a short time. The drying unit 8 includes conveyance belts and conveyance rollers for sending the sheet to the next processing.

The sheet winding unit 9 temporarily wind the continuous sheet on which front-surface printing has been finished when two-sided printing is performed. The sheet winding unit 9 includes a winding drum that rotates to wind the sheet. The winding drum temporarily winds the continuous sheet on which the front-surface printing has been finished and has not been cut yet. When winding is finished, the winding drum rotates in reverse to supply the wound sheet to the de-curl unit 2, and then sent it to the print unit 4. Since the sheet is reversed inside out, the print unit 4 can perform printing on the rear surface. More specific operation of the two-sided printing will be described below.

The discharge and conveyance unit 10 conveys the sheet cut by the cutter unit 6 and dried by the drying unit 8, and sends the sheet to the sorter unit 11. The sorter unit 11 separates as necessary the sheets on which the printing has been finished, to discharge them to different trays of the discharge tray 12 for each group.

The control unit 13 controls an overall printer. The control unit 13 includes a central processing unit (CPU) 100, a memory retaining a control program, a controller 15, and an interface unit. The control unit 13 communicates with an external device 16 via an interface.

Figure 2:
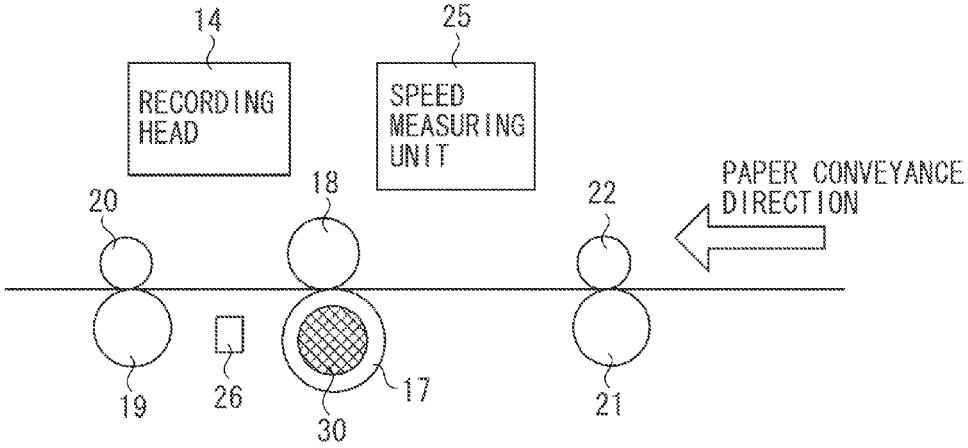
FIG. 2 illustrates a print unit illustrated in FIG. 1.

FIG. 2 illustrates the print unit 4 that performs recording on the recording medium. At an upstream side of the recording head 14, a main conveyance roller 17 and a main pinch roller 18 as a conveyance member are disposed. At a downstream side of the recording head 14, a sub conveyance roller 19, and a sub pinch roller 20 are disposed. Further at the upstream side of the main conveyance roller 17, a pre-main conveyance roller 21 and a pre-main pinch roller 22 are disposed. The recording medium is conveyed by the rollers in an arrow direction. A rotary encoder 30 is provided in the main conveyance roller 17, to detect a rotation phase of the main conveyance roller 17. A speed measuring unit 25 is disposed between the main conveyance roller 17 and the pre-main conveyance roller 21. An environment temperature detection sensor and an environment moisture detection sensor (not illustrated) are disposed in the periphery of the print unit 4. Furthermore, a sheet edge detection sensor 26 is disposed immediately beneath the recording head 14.

A drive source of the main conveyance roller 17 is a stepping motor 61. A motor control unit 60 included in the control unit 13 open-controls drive of the stepping motor 61 according to a predetermined speed table. The speed measuring unit 25 measures, for example, an average speed of the recording medium in a predetermined period (time period when the main conveyance roller 17 is rotated a plurality of times). This average speed is used to perform the control as the conveyance speed of the recording medium.

In addition, the speed measuring unit 25 measures a moving amount of the recording medium (amount of conveyance) to measure the speed. Thus, the control unit 13 acquires the moving amount of the main conveyance roller 17 for a predetermined rotation amount (unit rotation amount) from a rotation amount of the main conveyance roller 17 and the moving amount (conveyance amount) of the recording medium acquired from the signal from the rotary encoder 30.

The sheet is formed in a loop shape at the upstream side of the main conveyance roller 17 and at the downstream side of the sub conveyance roller 20 in the most downstream so that, when the sheet is conveyed in the periphery of the recording unit, the sheet is not influenced by the conveyance roller disposed in other than the periphery of the recording unit. Further, pressing force of the main pinch roller 18 applied to the main conveyance roller 17 is set to be a value sufficiently larger than the pressing force of the sub pinch roller 20 applied to the sub conveyance roller 19 and the pressing force of the pre-main pinch roller 22 applied to the pre-main conveyance roller 21. With this arrangement, the sheet is conveyed along with the rotation of the main conveyance roller 17.

The recording element included in the recording head is driven based on record data. By driving the recording element, the ink is discharged from the nozzles and impacts on the recording medium. A first color corresponding to the record data is recorded by a first color nozzle of the recording head. Next, a second color corresponding to the record data is recorded by a second color nozzle. By repeating the recording by a third color nozzle, a fourth color nozzle, and so on, the image is formed with the ink.

Figure 3A:
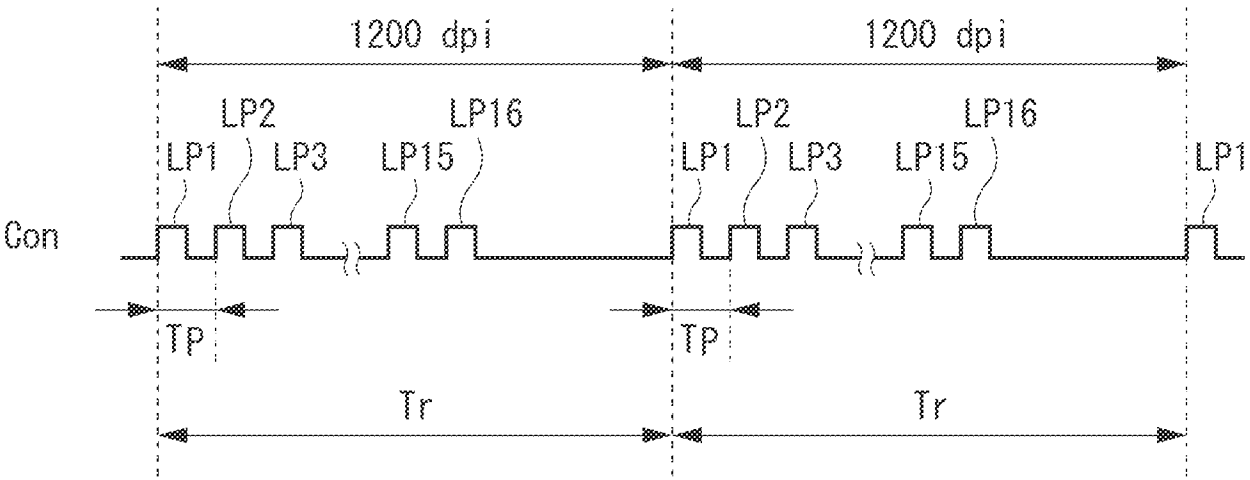
FIG. 3A illustrates timing of a drive reference signal for controlling drive timing of a recording head.
Figure 3B:
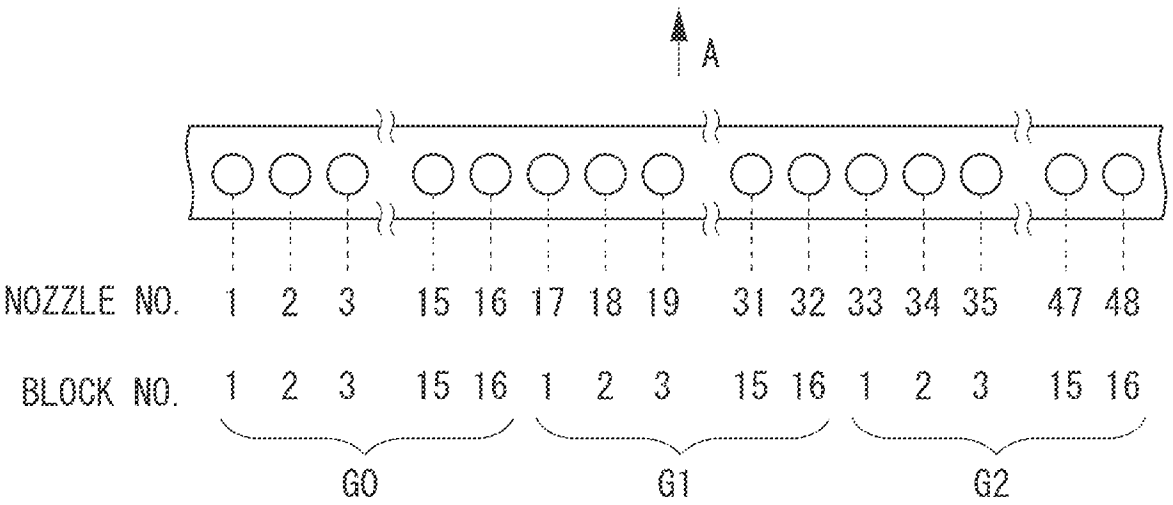
FIG. 3B illustrates the recording head.

FIG. 3A illustrates a drive reference signal Con for controlling the drive timing of the recording head. FIG. 3B illustrates the nozzles included in the recording head. Control pulses LP1 to LP16 illustrated in the FIG. 3A are the reference signals for driving the nozzles or signals for driving the plurality of nozzles by time-division. For a pulse width Tp of each of the control pulses (LP1 to LP16), a longer period is set than a period when the drive pulse for driving the recording element is turned on to discharge the ink once. This is drive reference signal Con. The control pulses LP1 to LP16 are expressed as a pulse train. An interval Tr from a previous control pulse LP1 to a following control pulse LP1 corresponds to a resolution of 1200 dpi. The intervals of other control pulses LP2 to LP16 similarly correspond to 1200 dpi. FIG. 3B illustrates the nozzle array for one color ink included in the recording head. The nozzle array is disposed in a direction intersecting a direction (arrow A) in which the recording medium is conveyed. A length of the nozzle array is longer than the width of the recording medium. Herein, a case where forty eight nozzles are included will be described for the sake of simple description.

FIG. 3B illustrates the nozzle array including a plurality (forty eight, herein) of nozzles. In the nozzle array, the neighboring nozzles are divided into three groups (first group G0, second group G1, and third group G2). The nozzles belonging to each group are allocated to any of blocks 1 to 16. For example, a nozzle 1, a nozzle 17, and a nozzle 33 are allocated to a block No1. A nozzle 2, a nozzle 18, and a nozzle 34 are allocated to a block No2. As illustrated in the FIG. 3A, the recording element corresponding to the nozzle allocated to the block No1 is driven based on the timing signal generated with reference to a control pulse LP1. Similarly, the recording element corresponding to the nozzle allocated to the block No2 is driven based on the timing signal generated with reference to a control pulse LP2. As described above, based on the control pulses LP1 to LP16, the recording element included in the recording head is driven at different timing for each block (time-division drive is performed). The recording element corresponding to the nozzle also forms the recording element array corresponding to the nozzle array.

Figure 4A:
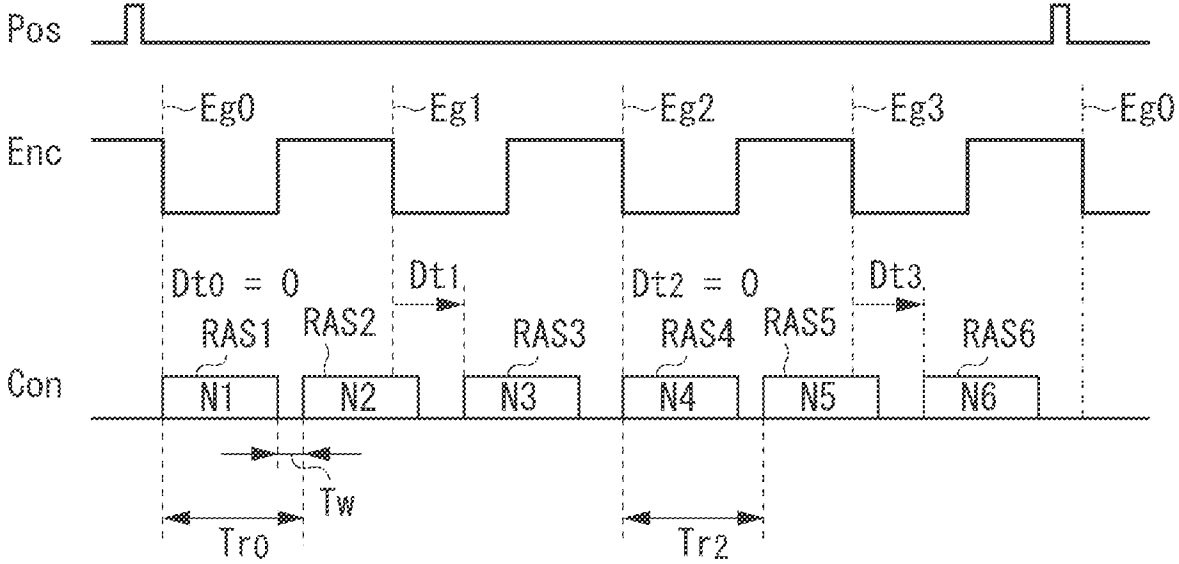
FIG. 4A illustrates timing of the reference signal, an encoder signal, and a roller reference signal illustrated in FIGS. 3A, 3B.

FIG. 4A illustrates output timing of an output encoder signal Enc according to a rotation of the main conveyance roller 17 and the drive reference signal Con illustrated in FIGS. 3A, 3B. A signal Pos is output from a roller reference sensor 31 every time the main conveyance roller 17 performs one rotation. FIG. 4A illustrates timing control for performing recording for six raster lines while the main conveyance roller 17 performs one rotation at a conveyance speed V1 of the recording medium. Herein, a case adopting six raster lines will be described for the sake of simple description of FIG. 4A. Each of pulse trains RAS1 to RAS6 is a timing signal of each raster. In other words, focusing on one nozzle, while the main conveyance roller 17 performs one rotation, the control unit 13 outputs the timing signal such that the recording for the six raster lines can be performed on the recording medium at an equal interval.

If the conveyance speed of the recording medium is V2 (speed faster than V1), to perform the recording for seven raster lines while the main conveyance roller 17 performs one rotation, the control unit 13 outputs the pulse trains RAS1 to RAST. If the conveyance speed of the recording medium is V3 (speed slower than V1), to perform the recording for five raster lines while the main conveyance roller 17 performs one rotation, the control unit 13 outputs the pulse trains RAS1 to RAS5. These raster numbers are the values that are used to illustrate the control intelligibly.

A waiting time Tw is provided from an end of a previous pulse train RAS until a start of a following pulse train RAS. For example, the period Tw is provided between the pulse train RAS1 and the pulse train RAS2, and between the pulse train RAS2 and the pulse train RAS3.

As illustrated in the FIG. 4A, the pulse train RAS is output based on an edge of the encoder signal. In the FIG. 4A, for the sake of simple description, it is assumed that, while the main conveyance roller 17 performs one rotation, the rotary encoder 30 generates a signal having four falling edges. A case will be described in which the recording for the six raster lines is performed based on the signal of the rotary encoder 30. Although values vary depending on a configuration of the conveyance unit, as an example of the number of signals actually used, the number of edges for one rotation of the main conveyance roller 17 is set to 4050, and a reference value of the number of raster lines at the reference conveyance speed at that time is set to 4450.

Before performing a recording operation, the control unit 13 determines the number of pulse trains, an interval Tp of the pulses, an output interval Tr of the pulse trains, and a delay time Dt while the main conveyance roller 17 performs one rotation. These parameters are determined based on information about the moving amount of the recording medium per a predetermined rotation amount (predetermined rotation angle) of the main conveyance roller 17, the conveyance speed of the recording medium, and the eccentricity of the main conveyance roller 17. FIG. 4B is an example of a table to be determined. The table stores parameters for performing the recording for six raster lines based on four falling edges (Eg0, Eg1, Eg2, Eg3) of the encoder signal generated while the main conveyance roller 17 performs one rotation.

The parameters will be described. The pulse trains RAS1 and RAS2 are sequentially output to perform the recording for two raster lines (N1 raster and N2 raster) based on the edge Eg0. The control pulses included in such pulse trains have an interval Tp0. There is an interval Tr0 between the pulse train RAS1 and the pulse train RAS 2. There is a delay time of 0. Based on the edge Eg1, the pulse train RAS3 is output to perform the recording for one raster line (N3 raster). The pulse train RAS3 is output, being delayed from the timing of edge Eg1 by the delay time Dt1. There is an interval Tp1 between the control pulses included in the pulse train RAS3. Based on the edge Eg2, the pulse trains RAS4 and RAS5 are sequentially output to perform the recording for two raster lines (N4 raster and N5 raster). There is an interval Tp2 between the control pulses included in the pulse trains.

There is an interval Tr2 between the pulse train RAS4 and the pulse train RAS5. There is a delay time of 0. Based on the edge Eg3, the pulse train RAS6 is output to perform the recording for one raster line (N6 raster). The pulse train RAS6 is output, being delayed from the timing of the edge Eg3 by the delay time Dt3. There is an interval Tp3 between the control pulses included in the pulse train RAS6. According to the present exemplary embodiment, Tp0, Tp1, Tp2, and Tp3 are the same numerical value. Further, Tr0 and Tr2 are the same numerical value. However, to finely adjust the drive timing, at least one value of Tp0 to Tp3 may be set to a different value. Furthermore, Tr0 and Tr2 may be set to different values from each other.

Moreover, a part (correspondence between the edge and the pulse train) of the parameter to perform the recording for seven raster lines will be described. Based on the edge Eg0, the pulse train RAS1 and RAS2 are sequentially output to perform the recording for the two raster lines (N1 raster and N2 raster). Based on the edge Eg1, the pulse trains RAS3 and RAS4 are sequentially output to perform the recording for two raster lines (N3 raster and N4 raster). Based on the edge Eg2, the pulse trains RAS5 and RAS6 are sequentially output to perform the recording for two raster lines (N5 raster and N6 raster). Based on the edge Eg3, the pulse train RAST is output to perform the recording for one raster line (N7 raster).

The storage unit of the control unit 13 stores the parameters for performing the recording for five raster lines, the parameters for performing the recording for six raster lines, and the parameters for performing the recording for seven raster lines described above. The falling edge is used as an edge to be used for the control, however, a rising edge may be also used.

Figure 5:
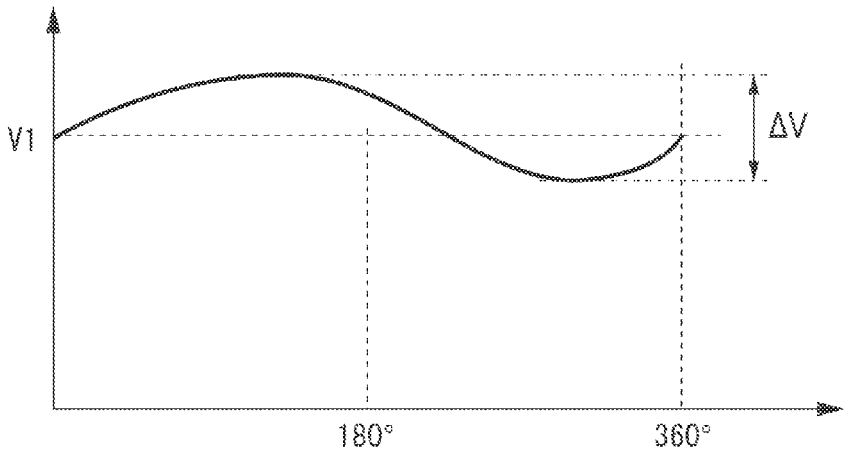
FIG. 5 illustrates a conveyance speed of a recording medium.

Next, speed fluctuation due to the eccentricity will be described. For example, a case is assumed in which there is difference in diameters of the main conveyance roller 17 at each phase thereof (from 0 to 90 degrees, from 90 degrees to 180 degrees, from 180 degrees to 270 degrees, and from 270 degrees to 360 degrees of an angle). FIG. 5 illustrates the speed fluctuation due to the difference in the diameters. For example, although the recording medium is conveyed at a conveyance speed V1, if focusing on a period when the main conveyance roller performs one rotation, the conveyance speed fluctuates by ΔV depending on the phase.

By the simple control configuration as described above, the timing signal can be output for driving the recording head with the timing corresponding to the movement (eccentricity of the main conveyance roller 17) of the recording medium. In particular, even when the number of raster lines recorded during one rotation of the roller is not divided by the number of edges of the encoder signal, the recording can be performed on the recording medium at an equal interval at resolution of 1200 dpi in the conveyance direction.

In addition, the timing of falling edges (Eg0, Eg1, Eg2, Eg3) of the encoder signal Enc may be shifted due to cogging of the stepping motor 61 that is the drive source of the main conveyance roller 17 and the eccentricity of a transmission member between the stepping motor 61 and the rotary encoder 30. However, by providing the waiting time Tw between the pulse train RAS and the pulse train RAS, even if the timing of the edge of the encoder signal is shifted, the timing of the previous pulse train RAS and the timing of the following pulse trans RAS can avoid overlapping each other, thereby preventing the recorded image from being deteriorated.

Figure 6:
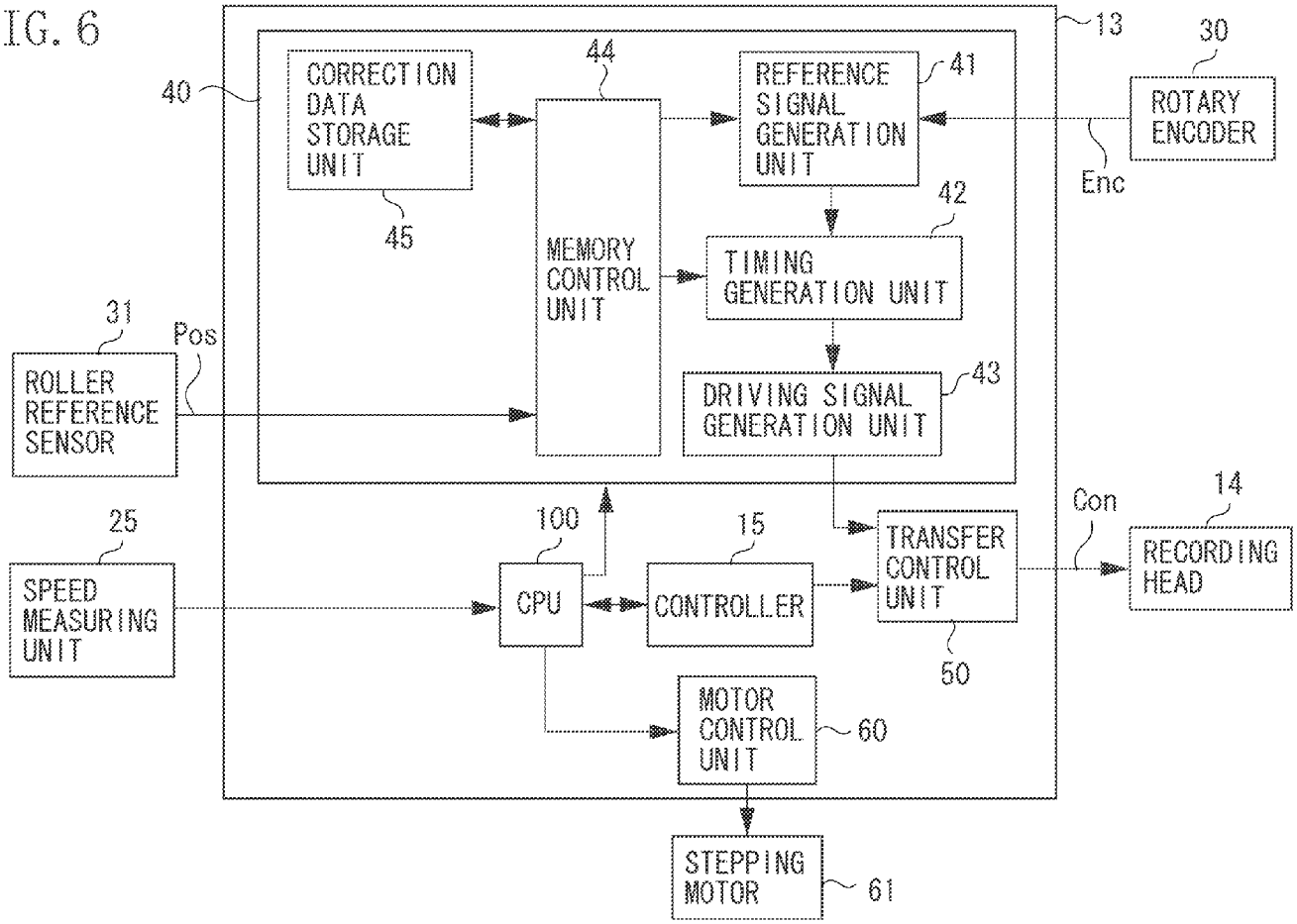
FIG. 6 is a block diagram of a control unit of the recording apparatus.

FIG. 6 illustrates the control unit 13. The control unit 13 includes the CPU 100, the controller 15, the record timing generation unit 40, a transfer control unit 50, and the motor control unit 60.

A record timing generation unit 40 includes a reference signal generation unit 41, a timing generation unit 42, a drive signal generation unit 43, a memory control unit 44, and a correction data storage unit 45.

The reference signal generation unit 41 and the timing generation unit 42 input parameters from the correction data storage unit 45 via the memory control unit 44. The parameters are information for determining the drive timing of the recording head for performing the recording at a desired position, even if the speed is fluctuated by the moving speed and the eccentricity of the recording medium.

As the parameters described above, parameters (e.g., a parameter for the recording for five raster lines and a parameter for the recording for seven raster lines) corresponding to a plurality of conveyance velocities including a parameter for performing the recording for the six raster lines described above are determined.

The reference signal generation unit 41 acquires the delay timing Dt described above based on the parameters. The timing control unit 42 acquires Tp and Tr. Based on the control parameters described above, the drive signal generation unit 43 outputs the pulse train formed of the control pulses to the transfer control unit 50. The transfer control unit 50 transfers the pulse train to the recording head 14.

The recording head 14 includes a drive circuit (not illustrated) that drives the recording element corresponding to the nozzle and a drive control circuit that controls the drive circuit. The drive control circuit controls the drive of the recording element based on the control signal transferred from a transfer control unit 50 in addition to the drive reference signal Con. The drive circuit includes the recording element and a switch (e.g., transistor) for turning on the recording element for a predetermined period. In addition, in the recording head 14, the control signal (control data) transferred from the transfer control unit 50 includes information for selecting the recording element (block) to be driven and information about the period when the drive pulse for driving the recording element is turned on.

The reference signal generation unit 41 inputs the signal from the rotary encoder 30. The memory control unit 44 inputs the signal from the speed measuring unit 25 and the roller reference sensor 31 that detects a rotation reference position of the main conveyance roller 17. The speed measuring unit 25 may be, for example, a laser Doppler speed meter.

The controller 15 generates record data from data input from the external device 16 (refer to FIG. 1), and transfers the record data to the recording head 14 in units of raster. According to the example described above, while the main conveyance roller 17 performs one rotation, the record data for the six raster lines can be transferred.

Figure 7:
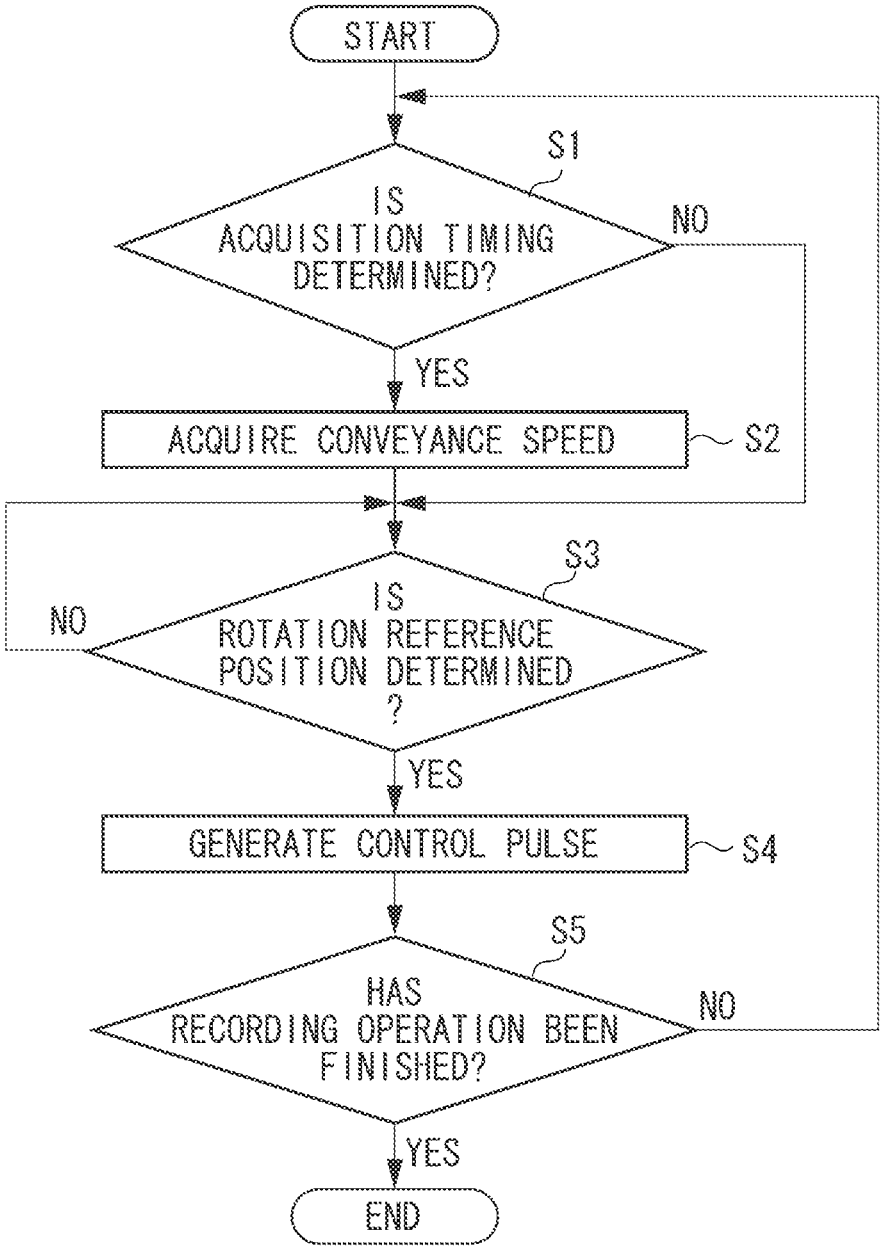
FIG. 7 illustrates a flow performed by the control unit.

FIG. 7 is a control flow illustrating control pulse generation. When the record operation is performed, a processing flow is started. In step S1, whether it is acquisition timing is determined. When it is the acquisition timing (Yes in step S1), in step S2, the conveyance speed is acquired from the speed measuring unit 25. When it is not the acquisition timing (NO in step S1), the processing proceeds to step S3. In step S3, whether it is a rotation reference position is determined. When it is the rotation reference position (YES in step S3), in step S4, the control pulse is generated. When it is not the rotation reference position (NO in step S3), the processing returns to step S3. In step S5, whether the recording operation has finished is determined. When the recording operation has finished (YES in step S5), the processing ends. On the other hand, when the recording operation has not finished (NO in step S5), the processing returns to step S1.

In addition, when the record operation is started, the conveyance speed of the recording medium is acquired at least once. An example of the acquisition timing in step S1 is the timing before a job is started in which the recording apparatus performs the recording operation. Further, the moving amount for the predetermined rotation amount (unit rotation amount) of the main conveyance roller 17 is acquired as a processing of step S2, and then, based on the moving amount, the control pulse may be generated.

As described above, the exemplary embodiment of the present invention has been described, however, the values are not limited to the values described above. Furthermore, the configuration of the printer is not limited either. For example, FIG. 2 illustrates the configuration in which the rollers convey the recording medium, however, a conveyance device (belt conveyance device) may be adopted in which the belt is hung on the pair of rollers. In this case, the speed measuring unit 25 measures the moving speed of the belt not the conveyance speed of the recording medium, and then based on the measured results, the control is performed. Moreover, the recording head 14 including one nozzle array is described, however, the nozzle array may be formed by disposing a plurality of chips. For example, to form the nozzle array including forty eight nozzles, four element substrates (chips) including the nozzle array including twelve nozzles may be disposed to form the nozzle array including forty eight nozzles. Further, the drive control circuit is included in the recording head 14, and also may be included in the control unit 13.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-027541 filed Feb. 10, 2011, which is hereby incorporated by reference herein in its entirety.

What is claimed is:

1. A recording apparatus comprising:

a recording head including a plurality of printing elements;

a roller configured to convey a recording medium;

a recording timing generation unit configured to generate a timing signal for performing recording for a raster line according to a rotation of the roller during one rotation thereof; and a drive signal generation unit configured to generate drive reference signals for driving the plurality of printing elements to record for a plurality of raster lines on the recording medium conveyed by the roller according to a timing of an edge of the timing signal, wherein the drive signal generation unit generates the drive reference signal for driving the plurality of printing elements to record a predetermined raster line so as to delay generation of the drive reference signal from a timing of an edge of the timing signal for a period such that a timing at which the predetermined raster line is recorded and a timing at which a raster line prior to the predetermined raster line is recorded to not overlap with each other.

2. The recording apparatus according to claim 1, further comprising an acquisition unit configured to acquire an conveyance information about a conveyance amount for conveying the recording medium per a predetermined rotation amount of the roller, wherein the drive signal generation unit is configured to acquire a number of raster lines to be recorded on the recording medium while the roller performs one rotation based on the conveyance amount information acquired by the acquisition unit.

3. The recording apparatus according to claim 1, wherein the recording head is configured to include a recording element array including at least a first recording element and a second recording element, wherein the first recording element is configured to be driven based on a first pulse of the drive reference signal, and the second recording element is configured to be driven based on a second pulse thereof to perform recording corresponding to one raster line.

4. The recording apparatus according to claim 1, wherein the recording head is configured to include a recording element array including a plurality of recording elements, wherein the recording element array is configured to include at least a first group and a second group that each include the plurality of recording elements as a unit, and wherein the recording head further comprises a drive control circuit configured to select a recording element to be driven from among the first group and the second group, and control drive of the selected recording element based on the drive reference signal.

5. The recording apparatus according to claim 1, wherein the drive signal generation unit is configured to include a rotary encoder.

6. The recording apparatus according to claim 1, the plurality of recording elements are configured to be disposed in a direction intersecting a direction in which the recording medium is conveyed.

7. The recording apparatus according to claim 1, wherein the recording head including nozzles from which ejecting ink by driving of the plurality of printing elements.

8. The recording apparatus according to claim 1, wherein the plurality of printing elements are electrothermal conversion devices.

9. The recording apparatus according to claim 1, wherein the plurality of printing elements are piezoelectric elements.

10. The recording apparatus according to claim 1, wherein the recording head is a line type on which a nozzle array of an inkjet method is formed within a range for covering the maximum width of the recording medium that is assumed to be used.

11. The recording apparatus according to claim 1, wherein the drive signal generation unit generates the drive reference signal for the predetermined raster line so as to delay generation of the drive reference signal from the timing of the edge of the timing signal for a period and generating the drive reference signal for the raster line prior to the predetermined raster line at a timing depending on a edge of a timing signal.

12. A recording apparatus comprising:

a recording head including a plurality of printing elements;

a roller configured to convey a recording medium;

a recording timing generation unit configured to generate a timing signal for performing recording for a raster line according to a rotation of the roller; and a drive signal outputting unit configured to output drive reference signals for driving the plurality of printing elements to record for a plurality of raster lines on the recording medium conveyed by the roller according to a timing of an edge of the timing signal generated by the recording timing generation unit, wherein the drive signal outputting unit outputs the drive reference signal based on parameter, stored in memory, indicating delay time for which the drive reference signal is outputted from a timing of an edge of the timing signal, in respect to each of edges of the timing signal generated by the recording timing generation unit.

13. The recording apparatus according to claim 12, wherein the parameter indicates a number of raster of which drive reference signals are outputted and a plurality of the drive reference signal are outputted by the drive signal outputting unit according to one edge of the timing signal.

14. The recording apparatus according to claim 13, wherein the parameter indicates one drive reference signal are outputted according to other edge of the timing signal.

15. The recording apparatus according to claim 13, wherein the parameter further indicates time interval between output timings of the plurality of the drive reference signal outputted according to one edge of the timing signal.

16. The recording apparatus according to claim 12, wherein the parameter indicates the delay time is 0 for one edge of the timing signal and the delay time is larger than 0 for other edge of the timing signal.

17. The recording apparatus according to claim 12, the plurality of recording elements are configured to be disposed in a direction intersecting a direction in which the recording medium is conveyed.

18. The recording apparatus according to claim 12, wherein the recording head including nozzles from which ejecting ink by driving of the plurality of printing elements.

19. The recording apparatus according to claim 12, wherein the recording head is a line type on which a nozzle array of an inkjet method is formed within a range for covering the maximum width of the recording medium that is assumed to be used.

20. A recording apparatus comprising:

a recording head including a plurality of printing elements;

a roller configured to convey a recording medium;

a recording timing generation unit configured to generate a timing signal for performing recording for a raster line according to a rotation of the roller; and a drive signal outputting unit configured to output drive reference signals for driving the plurality of printing elements to record for a plurality of raster lines on the recording medium conveyed by the roller according to a timing of an edge of the timing signal generated by the recording timing generation unit, wherein the drive signal outputting unit outputs the drive reference signal based on parameter, stored in memory, indicating a number of raster of which drive reference signals are outputted, in respect to each of edges of the timing signal generated by the recording timing generation unit.

21. The recording apparatus according to claim 12, wherein the parameter indicates a plurality of the drive reference signal are outputted according to one edge of the timing signal and one drive reference signal are outputted according to other edge of the timing signal.

* * * * *